US010603815B2

(12) United States Patent
Gonzalez

(10) Patent No.: US 10,603,815 B2
(45) Date of Patent: Mar. 31, 2020

(54) CONCRETE FORM SYSTEM

(71) Applicant: Adrian Rivera Gonzalez, Calgary (CA)

(72) Inventor: Adrian Rivera Gonzalez, Calgary (CA)

( * ) Notice: Subject to any disclaimer, the term of this patent is extended or adjusted under 35 U.S.C. 154(b) by 128 days.

(21) Appl. No.: 15/455,087

(22) Filed: Mar. 9, 2017

(65) Prior Publication Data

US 2018/0258653 A1 Sep. 13, 2018

(51) Int. Cl.

| | |
|---|---|
| ***B28B 7/16*** | (2006.01) |
| ***B28B 7/30*** | (2006.01) |
| ***E04G 15/06*** | (2006.01) |
| ***E04B 5/48*** | (2006.01) |
| ***E04G 15/04*** | (2006.01) |

(52) U.S. Cl.
CPC ..... *B28B 7/306* (2013.01); *B28B 7/16* (2013.01); *E04B 5/48* (2013.01); *E04G 15/04* (2013.01); *E04G 15/063* (2013.01)

(58) Field of Classification Search
CPC ..... E04G 15/063; E04G 15/04
See application file for complete search history.

(56) References Cited

U.S. PATENT DOCUMENTS 1,391,988 A * 9/1921 Zents ..... E04G 15/063 249/179
1,396,280 A * 11/1921 Paine ..... E04G 15/063 249/177
2,234,784 A * 3/1941 Stolz ..... E04G 15/063 249/179
2,588,631 A * 3/1952 Maxwell ..... E04G 15/063 52/713
2,593,456 A * 4/1952 Maxwell ..... B28B 7/303 249/183
2,614,310 A * 10/1952 Maxwell ..... E04G 15/063 249/176
3,294,358 A * 12/1966 Hagedorn ..... F16L 7/00 249/175
3,346,230 A * 10/1967 Tolf, Jr. ..... E04G 15/063 249/177
3,469,817 A * 9/1969 Bowden ..... E04G 15/063 249/183
3,933,336 A * 1/1976 Tolf, Jr. ..... E04G 15/04 249/177
2015/0330079 A1* 11/2015 Sorkin ..... B28B 7/28 249/188
2015/0336289 A1* 11/2015 Comerford ..... E04G 15/04 264/317
2017/0037624 A1* 2/2017 Sorkin ..... E04C 5/122

* cited by examiner

*Primary Examiner* — Benjamin A Schiffman

(57) ABSTRACT

A reusable form for creating conduit paths in concrete slabs is described. The form comprises a flexible tube that is positioned prior to pouring a concrete slab. The form includes a keep to keep material out of the hole formed by the form. The form also includes a key structure to permit easy removal of the form once the concrete is set. The system further includes a sighting device to permit rapid and precise alignment for placement of a form when forming conduits in a multi-level building. An accessory is also provided permitting filling in the opening created by the form once wiring, piping and other objects have been installed within the conduit.

4 Claims, 4 Drawing Sheets

CONCRETE FORM SYSTEM

This invention is in the field of concrete forms and in particular forms used to create conduit pathways within concrete slabs.

BACKGROUND

In the field of construction, concrete is commonly used as a structural material, both in floors and walls. In the process of creating concrete structure it is common to also make some provision for creating pathways through the concrete for a variety of electrical and mechanical services. For example, channels or conduits in the concrete allow for passage of wiring, plumbing and like services from one side of a concrete structure to the opposite side.

One method for creating passageways in concrete slabs involves cutting holes after the concrete has set. This method has several disadvantages including the fact that it is a time-consuming process, and risks damaging the concrete and reinforcing bar that is frequently present inside a slab. Another method has been to use conduits or forms to create the desired channels in concrete slabs. Several examples exist in the prior art describing forms for use in creating voids in concrete slabs through which components such as electrical wiring and plumbing can be later passed as the building is completed. For example, an early example of a hollow form for creating a conduit in a concrete slab is described in U.S. Pat. No. 963,544 (Graeff). The theme of creating hollow channels in concrete structures has been described in yet other patents (e.g., U.S. Pat. No. 1,530,200; Richardson). Similarly, apparatus for maintaining a conduit in a fixed position prior to the pouring of a concrete slab have also been described (U.S. Pat. No. 3,163,909; Williams).

More modern solutions to this problem include placing a hollow form within the space in which a concrete slab is to be poured. The hollow form creates a void in the concrete, which later can be used to pass electrical and mechanical services. In some cases, the form is left in place and so is one use only. In other cases the form can be removed and so is reusable.

These prior art examples of conduits and forms all suffer from various limitations. For example, where forms are not reusable, there is significant waste in material and cost. Even when reusable forms are used, there are still several limitations. For example, when constructing multi-level building it is often the case that electrical and mechanical services will be run from floor to floor to floor. This requires aligning conduit holes in succeeding floors so that the services can follow a straight path and as they ascend or descend within the building.

Also, in cases where it is desired to fill the conduit once services are put in place, prior art apparatus do not easily provide a way in which to accomplish that step. Moreover, when the forms are removed, there is no way in which to easily include reinforcing material such as steel bars to improve the structural performance within the former conduit void.

SUMMARY OF THE INVENTION

The following discussion provides many example embodiments of the inventive subject matter. Although each embodiment represents a single combination of inventive elements, the inventive subject matter is considered to include all possible combinations of the disclosed elements.

Thus, if one embodiment comprises elements A, B, and C, and a second embodiment comprises elements B and D, then the inventive subject matter is also considered to include other remaining combinations of A, B, C, or D, even if not explicitly disclosed.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

The present invention comprises a flexible, reusable, form for forming voids in concrete slabs. The form conveniently comprises ribs that serve to assist a user in removing the form from the concrete once the concrete has set. The form further comprises a dock for engaging a tool with which to more easily remove the form from a set concrete slab, as well as a system for aligning forms in successive floors in a multi-level building. Thus, in some embodiments the invention provides a form assembly for forming a void in a volume of concrete, the form assembly comprising: a cylinder, the cylinder comprising a body, a first end, and second end; a flange, the flange located at an end of the cylinder, and substantially encircling the perimeter of the cylinder, and configured to permit a user to secure the form assembly in a desired position on a structure erected to receive a volume of concrete; a cap, the cap configured to substantially seal the end of the cylinder opposite to the end of the cylinder where the flange is located; at least one rib, the at least one rib located along, and extending above the surface of the body of the cylinder, wherein the at least one rib has a first end and a second end, and wherein the at least one rib is configured to assist a user in causing the release of the form assembly from a volume of concrete that has sufficiently cured such that the volume of concrete will maintain a desired shape once the form assembly is removed; a dock, the dock configured to receive a tool that can be manipulated by a user to remove the form assembly from the volume of concrete.

In some embodiments, the first end of the at least one rib extends laterally outwards from the body of the cylinder, and the second end of the at least one rib is substantially flush with the surface of the body of the cylinder.

In some embodiments, the first end and second ends of the at least one rib are radially separated by an arc of less than 180°. In some embodiments, the first end and second ends of the at least one rib are radially separated by an arc of less than 120°. In some embodiments, the first end and second ends of the at least one rib are radially separated by an arc of less than 90°. In some embodiments, the first end and second ends of the at least one rib are radially separated by an arc of about 90°.

There is also provided a method of forming a void in a volume of concrete, the method comprising: providing a form assembly for forming a void in a volume of concrete, the form assembly comprising: a cylinder, the cylinder comprising a body, a first end, and second end; a flange, the flange located at an end of the cylinder, and substantially encircling the perimeter of the cylinder, and configured to permit a user to secure the form assembly in a desired position on a structure erected to receive a volume of concrete; a cap, the cap configured to substantially seal the end of the cylinder opposite to the end of the cylinder where the flange is located; at least one rib, the at least one rib located along, and extending above the surface of the body of the cylinder, wherein the at least one rib has a first end and a second end, and wherein the at least one rib is configured to assist a user in causing the release of the form assembly from a volume of concrete that has sufficiently cured such that the volume of concrete will maintain a desired shape once the form assembly is removed; a dock, the dock configured to receive a tool that can be manipulated by a user to remove the form assembly from the volume of concrete; placing the form assembly in a location where it is desired to form a void in the volume of concrete; securing the form assembly to the structure erected to receive the volume of concrete; placing the cap on the end of the cylinder opposite the end where the flange is located; pouring the volume of concrete; allowing the volume of concrete to cure to an extent such that it will maintain a desired shape; removing the cap from the cylinder; accessing the dock with a tool configured to assist a user in rotating the form assembly within the formed void; and rotating the form assembly through an arc sufficient to permit the form assembly to be released from the void formed in the volume of concrete.

In some embodiments of the method, rotating the form assembly comprises rotating the form assembly such that the first end of the at least one rib is moved from a first position to a second position. In some embodiments of the method, the first position is the position of the first end of the at least one rib when the form assembly is positioned prior to pouring the volume of concrete, and the second position is a position occupied by the form assembly after rotating the form assembly for the purpose of releasing the form assembly from the set concrete.

In some embodiments of the method, moving the form assembly from the first position to the second position involves rotating the form assembly through an angle of less than 180°. In some embodiments of the method, moving the form assembly from the first position to the second position involves rotating the form assembly through an angle of less than 120°. In some embodiments of the method, moving the form assembly from the first position to the second position involves rotating the form assembly through an angle of less than 90°. In some embodiments of the method, moving the form assembly from the first position to the second position involves rotating the form assembly through an angle of about 90°. In some embodiments of the method, moving the form assembly from the first position to the second position involves rotating the form assembly through an angle such that the first end of the at least one rib is rotated to a position such that the first end of the at least one rib is now located at the position formerly occupied by the second end of the at least one rib prior to pouring the volume of concrete.

In some embodiments the method further comprises, placing an alignment tool in a location formerly occupied in the volume of concrete by the cap. In some embodiments the method further comprises using the alignment tool to indicate a position for placing a form assembly for forming a void in a subsequent volume of concrete to be poured. In some embodiments of the method, the alignment tool comprises an optical reticle configured to project an image of an illumination source on the position for placing a form assembly for forming a void in a subsequent volume of concrete to be poured. In some embodiments of the method, the illumination source is a laser beam.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

The present disclosure describes a system and method for forming openings in concrete slabs through which to pass service components such as electrical wiring, plumbing conduits and the like. The system provides a form that is removable from a concrete slab once the concrete has sufficiently hardened to hold it shape. In addition, the form is reusable. The form is shaped such that it forms one or more grooves in the wall of the hole formed in the concrete slab. These grooves are adapted to receive reinforcing material, such as metal reinforcing bar.

Figure 1A:
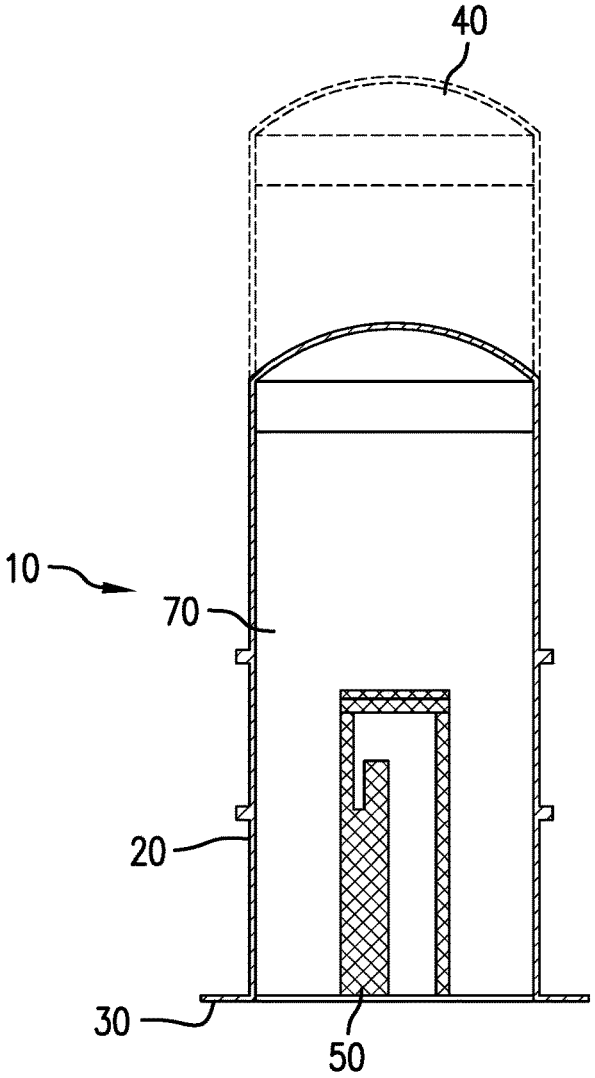
FIGS. 1A and 1B are side cross-sectional views of an embodiment of a concrete sleeve form according to the present disclosure.

As shown in FIG. 1A, in one embodiment, a concrete form assembly 10 comprises a cylinder 20 and base 30. The cylinder defines the shape and dimensions of the space to be formed in a concrete slab by the form 10. The form assembly further comprises a removable cap 40. The assembly also includes a tool dock 50 that is configured to receive a tool used in removing the form assembly from the concrete slab once the concrete has cured sufficiently to maintain its shape.

Preferably, the cylinder portion of the concrete form assembly can be fashioned from a pliable material in order to improve the ease of removal once the concrete slab it is placed in has cured sufficiently. A number of materials are suitable for use in manufacturing the cylinder, including various plastics such as polyethylene and polypropylene. Those of skill in the art will be aware of other similarly suitable materials. The removable cap may also be fashioned from a variety of pliable materials including plastics or natural or synthetic rubber materials.

Figure 1B:
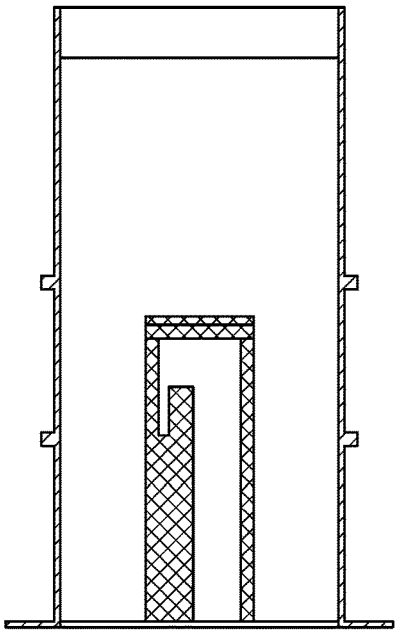

The base 30 in one embodiment comprises a flange as can be seen in the top view of the assembly in FIG. 1B. The base can further include holes 60 that can be used to secure the form assembly to a concrete form, whether it be made from wood or metal, using screws, wire or other forms of fastener.

Figure 1C:
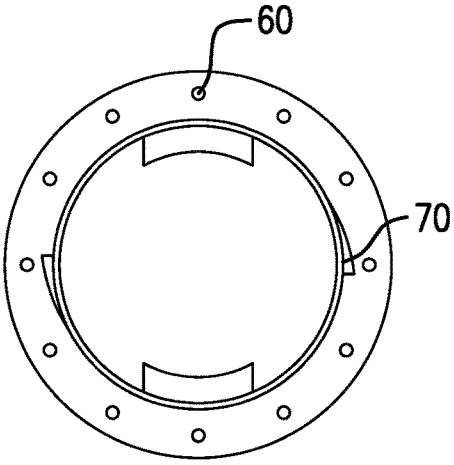
FIG. 1C is a top view of the embodiment depicted in FIG. 1B.

The side walls of the cylindrical portion of the form assembly can also include ribs 70. In one example, as better appreciated in FIG. 1C, the ribs 70 extend outward from the body of the cylinder. In addition, in a preferred embodiment, the ribs taper such that starting from extending a maximal distance out from the body of the cylinder at one location, they gradually taper to the point where the rib becomes flush with the body of the cylinder. In one aspect, tapering occurs so that the rib becomes flush at approximately 90° of the way around the circumference of the cylinder. The ribs function to create tapering grooves in a concrete slab when the concrete is poured. These grooves have additional utility as will be described below.

Figure 2:
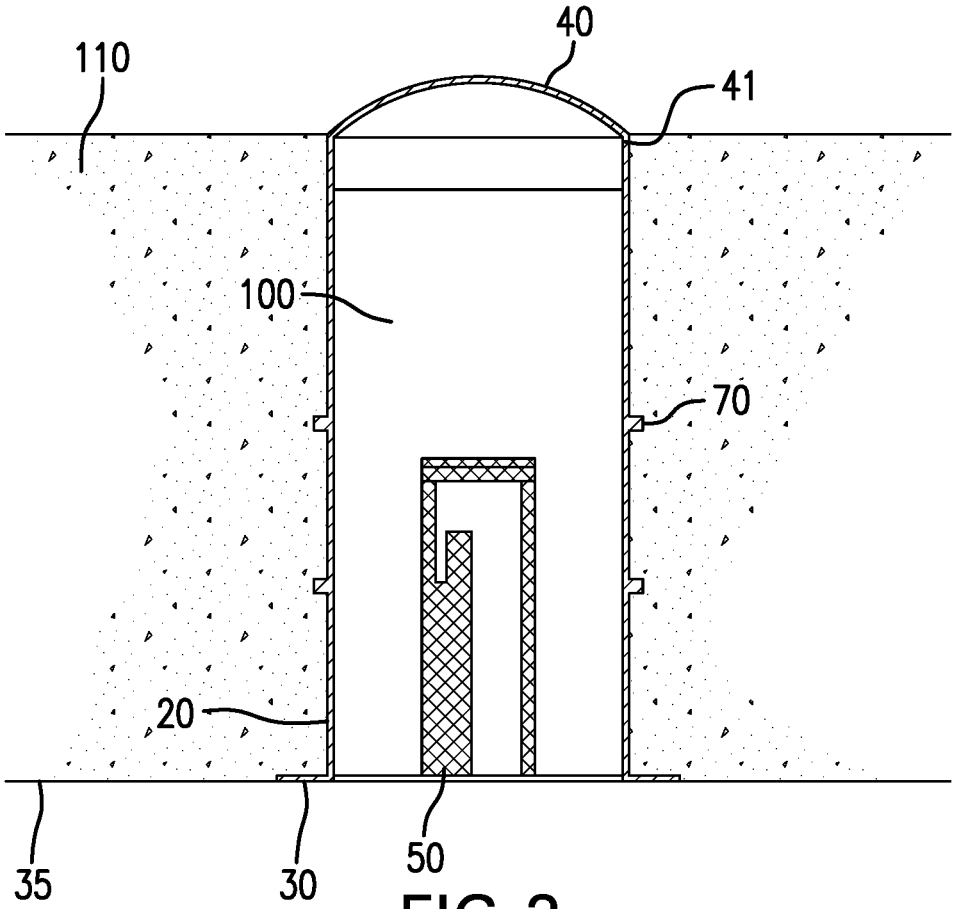
FIG. 2 is a side cross-sectional view of an embodiment of a concrete sleeve form in place within a concrete slab according to the present disclosure.
Figure 3:
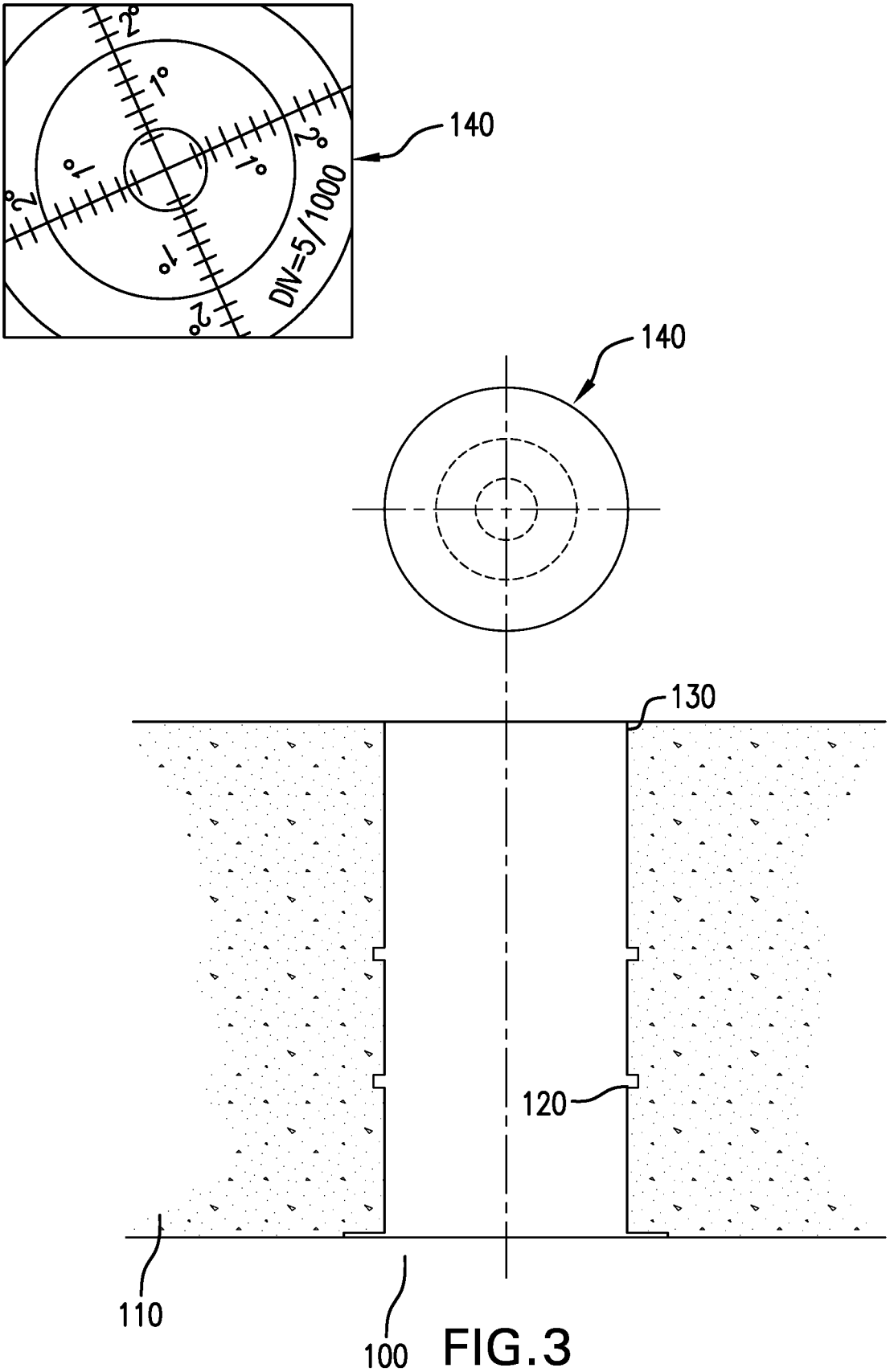
FIG. 3 is a side cross-sectional view of a space in a concrete slab formed by a sleeve of the present disclosure, and showing the use of an alignment reticle.

In use, the form assembly can be secured to a surface of a concrete form 35, such as a wooden or metal form used to define the shape of the concrete slab to be poured. As described above, the base 30 can be secured to the form 35, thereby keeping it in place during the operation of pouring the concrete slab. As shown in FIG. 2, the form assembly, when in place, will create a void 100 from which concrete 110 is excluded. The cap 40 serves two functions. First, during the process of pouring, the cap 40 prevents concrete from inadvertently entering the void 100 formed by the form assembly. Second, the cap 40 includes a cap flange 41 that forms a wider void at the top of the assembly, which in turns creates a recess 130 in the finished concrete slab at the top of the void 100, as shown in FIG. 3. This recess serves as a mounting receptacle for an alignment tool 140.

With respect to the alignment tool, it is common in multi-level buildings such as high-rise apartments and skyscrapers to have service components such as electrical wiring and plumbing to extend upward (or downward) through several floors. A challenge in placing forms to create holes in concrete slabs to run such service components is that it is generally desirable to have the void in one concrete slab generally in alignment with the void to be formed in the next slab (e.g., in the floor above). It is difficult to create such an alignment by eye, and so generally alignment will be done measuring the position of a void in a slab, and then trying to create the same positioning by measuring relative to structures on the floor above, such as the forms that are in place for walls, etc.

The present form assembly, which creates a ring 130 at one end of void 100 conveniently allows for the placement of an alignment tool 140. In one embodiment, the alignment tool comprises an optical reticle through which an illumination source, for example a laser light, can be shone to illuminate a spot on the concrete form in place on the floor above that of the formed void. By aligning the laser in a substantially vertical orientation, the laser will light a spot directly above the centerline of the void on which the reticle placed. Thus, the positioning of the next location of a void in the concrete slab can be precisely pre-determined in a single step. Positioning additional form assemblies in this way is both more precise than estimating the appropriate position for the next form assembly to be placed, and significantly faster than having to measure a position relative to other structures using traditional methods such as the use of a measuring tape.

One the concrete slab has been poured and the concrete has sufficiently cured such that it is able to maintain its shape, the present invention provides that the form assembly can be removed from the slab and reused. In some embodiments, removal of the form assembly is accomplished by engaging the tool dock 50 with a tool that can reversibly be secured to the assembly. Once engaged, the tool is then rotated resulting in the rotation of the form assembly within the void created by its placement within the now formed concrete slab. As the assembly is rotated, the force of rotation will cause the tapered rib structures to exert a force against the groove that they formed in the concrete. This force will cause deformation of the wall of the cylinder portion of the form assembly inwards. Once the form assembly has been rotated approximately 90° from its previous position, the position of the widest part of a rib will be flush with the wall of the void in the concrete, and at that point the form assembly can be removed being pulled out of the void it formed.

While the example refers to a rotation of 90°, that is one possible construction of the rib portion of the side wall of the cylinder. The ribs can be fashioned to taper over a region encompassing more, or less than, 90° around the cylinder side wall and still function as described. The angular measure between the maximum rib width and the position where the rib becomes flush with the remainder of the surface of the side wall and thus is not considered to be a limiting aspect of the invention. For example, in some case the rib structure may taper over an arc of 30°, or 45° or 60°. In some cases it may be preferred that the ribs taper over an arc of 90° or 120°, or 150°. In theory any arc less than 180° would lend itself to the operation of the ribs as described.

Figure 4:
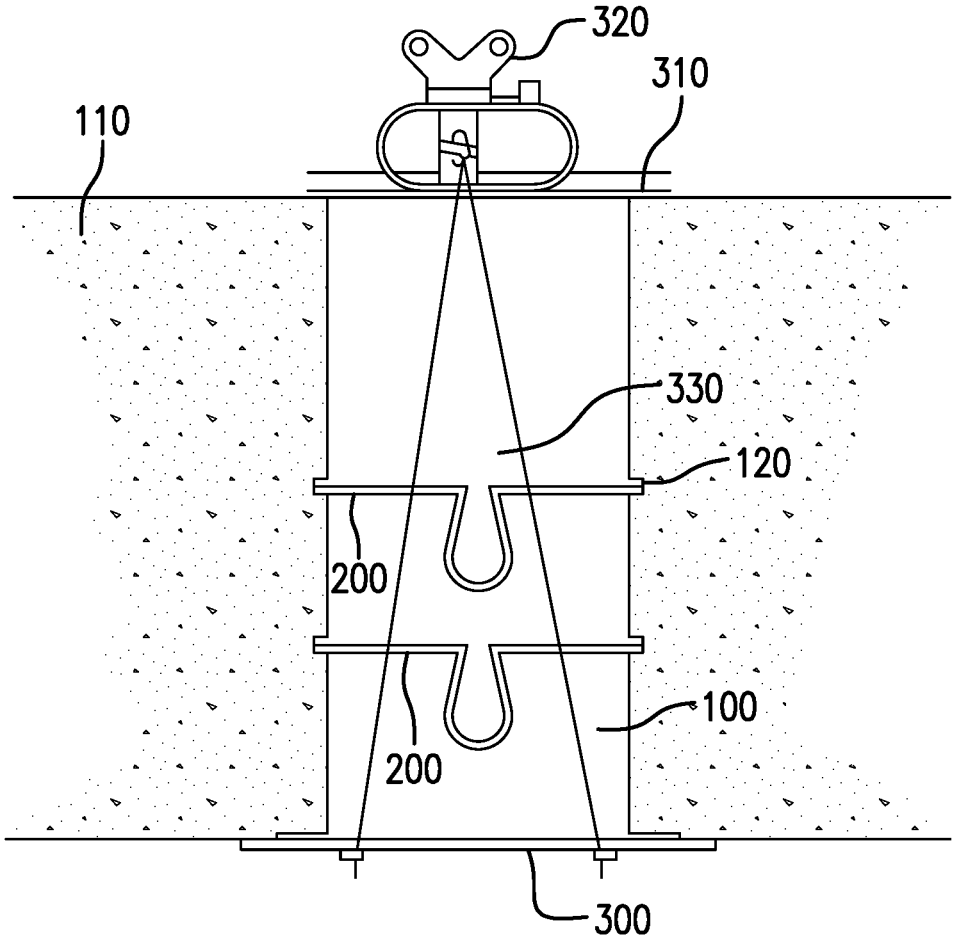
FIG. 4 is a side cross-sectional view of a space in a concrete slab formed by a sleeve of the present disclosure, along with an example of placement of reinforcing bar and forming plates to permit filling the space once components have been placed therein.

While not essential to the basic concept of forming a void in a concrete slab. The inclusion of the ribs in the form assembly provide additional advantages that do not exist in prior art concrete form sleeves. As shown in FIG. 4, the presence of indentations, or grooves, 120 formed by the ribs within the concrete slab provide a place in which to situate reinforcing elements 200. These reinforcing elements provide additional strength to the slab in cases where the void is re-filled with concrete once all the electrical and mechanical service components have been installed in the void region of the slab. This then allows for additional material to be poured into the void such that the concrete slab now forms a continuous barrier. This is a desirable feature to maintain physical separation between spaces on separate floors. For example, in the absence of a means of filling the remaining void, in cases such as a water leak, water would flow freely from an upper floor through the void down to a lower floor.

The invention claimed is:

1. A form assembly for forming a void in a volume of concrete, the form assembly comprising:

a cylinder, the cylinder comprising a body, a first end, and second end;

a flange, the flange located at an end of the cylinder, and substantially encircling the perimeter of the cylinder, and configured to permit a user to secure the form assembly in a desired position on a structure erected to receive a volume of concrete;

a cap, the cap configured to substantially seal the end of the cylinder opposite to the end of the cylinder where the flange is located;

at least one rib, the at least one rib located along, and extending above the surface of the body of the cylinder, wherein the at least one rib has a first end and a second end, and wherein the at least one rib is configured to assist a user in causing the release of the form assembly from a volume of concrete that has sufficiently cured such that the volume of concrete will maintain a desired shape once the form assembly is removed;

a dock, the dock configured to receive a tool that can be manipulated by a user to remove the form assembly from the volume of concrete;

wherein the first end of the at least one rib extends laterally outwards from the body of the cylinder, and the second end of the at least one rib is substantially flush with the surface of the body of the cylinder;

and wherein the first end and second ends of the at least one rib are radially separated by an arc of less than 180°.

2. The form assembly of claim 1, wherein the first end and second ends of the at least one rib are radially separated by an arc of less than 120°.

3. The form assembly of claim 1, wherein the first end and second ends of the at least one rib are radially separated by an arc of less than 90°.

4. The form assembly of claim 1, wherein the first end and second ends of the at least one rib are radially separated by an arc of about 90°.

* * * * *